US006293903B1

(12) United States Patent
Kasic, II et al.

(10) Patent No.: US 6,293,903 B1
(45) Date of Patent: Sep. 25, 2001

(54) APPARATUS AND METHOD FOR MOUNTING IMPLANTABLE HEARING AID DEVICE

(75) Inventors: James Frank Kasic, II, Boulder; Douglas Alan Miller, Lafayette, both of CO (US); William Howard Slattery, III, LaCanada, CA (US)

(73) Assignees: Otologics LLC, Boulder, CO (US); House Ear Institute, Los Angeles, CA (US)

( * ) Notice: Subject to any disclaimer, the term of this patent is extended or adjusted under 35 U.S.C. 154(b) by 0 days.

(21) Appl. No.: 09/583,202

(22) Filed: May 30, 2000

(51) Int. Cl.[7] ..... H04R 25/00
(52) U.S. Cl. ..... 600/25
(58) Field of Search ..... 600/25; 623/10, 623/11; 607/55–57; 181/126, 129

(56) References Cited

U.S. PATENT DOCUMENTS

| | | | |
|---|---|---|---|
| 4,655,776 | 4/1987 | Lesinski | 623/10 |
| 4,729,366 | 3/1988 | Schaeffer | 128/1.6 |
| 4,850,962 | 7/1989 | Schaeffer | 600/25 |
| 4,922,333 | 5/1990 | Nutting et al. | 358/78 |
| 4,957,478 | 9/1990 | Maniglia | 600/25 |
| 4,969,900 | 11/1990 | Fleischer | 623/10 |
| 5,015,224 | 5/1991 | Maniglia | 600/25 |
| 5,024,224 | 6/1991 | Engebretson | 128/420.6 |
| 5,085,628 | 2/1992 | Engebretson et al. | 600/25 |
| 5,163,957 | 11/1992 | Sade et al. | 623/10 |
| 5,217,011 | 6/1993 | Bisch | 128/420.6 |
| 5,282,858 | 2/1994 | Bisch et al. | 623/10 |
| 5,498,226 | 3/1996 | Lenkauskas | 600/25 |
| 5,531,787 | 7/1996 | Lesinski et al. | 623/10 |
| 5,549,658 | 8/1996 | Shannon et al. | 607/57 |
| 5,558,618 | 9/1996 | Maniglia | 600/25 |
| 5,702,342 | 12/1997 | Metzler et al. | 600/25 |
| 5,749,912 | 5/1998 | Zhang et al. | 607/57 |
| 5,788,711 | 8/1998 | Lehner et al. | 606/130 |
| 5,836,863 | 11/1998 | Bushek et al. | 600/25 |
| 5,906,635 | 5/1999 | Maniglia | 607/57 |
| 5,984,859 | 11/1999 | Lesinski | 600/25 |
| 5,999,632 | 12/1999 | Leysieffer et al. | 381/328 |
| 6,001,129 | 12/1999 | Bushek et al. | 623/10 |
| 6,010,532 | 1/2000 | Kroll et al. | 623/10 |

OTHER PUBLICATIONS

HNO Hals–Nasen–Ohren–Heilkunde, Kopf– und Hals–Chirurgie; Elektronische Horimplantate bei Innenohrschwerhorigkeiten; pp. A3–A5 and 737–880 10/97.

*Primary Examiner*—John P. Lacyk
(74) *Attorney, Agent, or Firm*—Marsh, Fischmann & Breyfogle LLP

(57) ABSTRACT

An improved apparatus and method is provided for supportably mounting an implantable hearing aid device to a patient's skull. The apparatus includes a support member adapted for supporting a hearing aid device and a plurality of mounting legs extending laterally from the support member in differing directions. A plurality of apertures are defined through each of the plurality of mounting legs, wherein an attachment device may be selectively inserted through each of one or more of the apertures for attachment of the apparatus to a patients skull. At least two of the apertures provided in each of the mounting legs may be disposed in a radially offset fashion relative to the support member and/or at different lateral distances relative to the support member. The provision of multiple mounting legs and apertures for interconnection provide enhanced mounting position flexibility, stability and overall ease of installation advantages.

20 Claims, 3 Drawing Sheets

APPARATUS AND METHOD FOR MOUNTING IMPLANTABLE HEARING AID DEVICE

FIELD OF THE INVENTION

The present invention relates to an apparatus and method for supportably mounting an implantable hearing aid device to a patient's skull, and more particularly, to a mounting apparatus and method that provides enhanced stability, mounting-position flexibility and/or ease-of-installation advantages.

BACKGROUND OF THE INVENTION

A number of different types of implantable hearing devices have been proposed. By way of primary example, such devices include those which utilize electromechanical or piezoelectric transducers for stimulation of the ossicular chain (see, e.g., U.S. Pat. No. 5,702,342), and those which utilize excitor coils to electromagnetically stimulate magnets affixed above to a bone in the middle ear (see, e.g., U.S. Pat. No. 5,897,486). Additional implantable approaches employ piezoelectric transducers to stimulate the ossicular chain.

In most instances, hearing aid devices of the above-noted nature entail supportably mounting at least a portion of a middle ear actuator to a patient's skull, wherein the supported portion is positioned in an opening surgically defined in the skull. Most typically, the supported portion is at least partially located within the mastoid process and requires stable and reliable placement. However, desirable locations for skull interconnection may be limited and can vary significantly from patient-to-patient, thereby adding to implant procedure complexity. In this regard, the required time associated with mounting during implant procedures is of growing concern given the high costs associated with surgical facility usage and the baseline objective of making implantable hearing aid devices an affordable option for the hearing impaired.

SUMMARY OF THE INVENTION

In view of the foregoing, a primary objective of the present invention is to provide an apparatus and method for implantable hearing aid device mounting that provides positioning-flexibility and enhanced stability.

A further primary objective of the present invention is to provide an apparatus and method for implantable hearing aid device mounting that can be implemented with reduced installation time and attendant cost relative to many current mounting devices/methods.

The above objectives and additional advantages may be realized by the inventive apparatus and method disclosed herein. The apparatus comprises a support member adapted to support an implantable hearing aid device within a patient's skull. The apparatus further includes a plurality of mounting legs (e.g., two or more) interconnected to and extending laterally away from the support member in a corresponding plurality of differing directions. Each of the plurality of mounting legs includes at least one mounting aperture for selectively receiving a skull attachment device therethrough.

In one aspect of the invention, the mounting legs may be disposed to radiate from a top end of the support member and may be spaced (e.g., equally) within a predetermined arc of $\beta°$ thereabout. For example, in one arrangement four mounting legs may be equally-spaced about an arc of 180°, wherein adjacent legs form 60° angles within the 180° arc. In another arrangement, three mounting legs may be spaced about a 180° arc, wherein adjacent legs define 90° angles therebetween. Additional combinations comprising two or more legs and varying radiating orientations will be apparent to those skilled in the art.

As may be appreciated, the provision of a plurality of mounting legs which laterally extend from a support member in a plurality of differing directions disposes the mounting apertures of the different mounting legs in radially offset positions from each other, thereby yielding enhanced positioning options for skull interconnection. Further, and in another aspect of the invention, at least one of the plurality of mounting legs, and preferably each of the mounting legs, may comprise a plurality of mounting apertures which are radially offset from each other. Additionally, it is preferable for each mounting leg to include at least two mounting apertures that are located at differing lateral distances from the support member.

In an additional inventive aspect, it may be preferable for the mounting legs to adjoin a top end of the support member in a substantially planar adjoinment region, and for the support member (e.g., a center axis thereof) to be disposed at an acute angle $\theta°$ relative to the substantially planar adjoinment region. Preferably, the acute angle $\theta°$ may be advantageously established at between about 20° to 70°. By way of example, alternative embodiments may be provided with $\beta°$ established at differing angles (e.g., 35° and 55°) to provide medical personnel with mounting apparatus options to address differing patient skull configurations.

In yet another aspect of the invention, the mounting legs may be disposed to radiate from a substantially planar support member adjoinment region in different directions within a first arc of $\beta°$, while the support member may be disposed to extend from the adjoinment region within a non-overlapping second arc of $360°-\beta°$. For example, in a top or plan view, the mounting legs may be provided to linearly radiate in different directions within a predetermined arc of $\beta°$ (e.g., 180°) about the adjoinment region, while the support member itself linearly radiates in yet another different direction outside of the predetermined arc of $\beta°$.

In a further aspect of the present invention, the plurality of mounting legs may be integrally formed with the support member. In this regard, the mounting legs and support member may comprise a material selected from a group consisting of: titanium (e.g., grade 1, grade 2 or commercially pure titanium), stainless steel, or plastic. Further, the surfaces of the mounting legs and/or support member may be finished to selectively promote or retard tissue and/or bone attachment. By way of example, where the mounting legs and/or support member are of metal construction, the surfaces may be roughened (e.g., grit-blasted) to enhance tissue attachment. Conversely, the surfaces may be chemically treated (e.g., with paclitaxal) to frustrate tissue attachment.

In a related aspect of the present invention the mounting legs may be adjoined to the support member in a fashion to render them bendable along their respective adjoinment regions within a predetermined angular range. Preferably, the predetermined angular range may be about ±30°. Such bendability allows the mounting legs to be pivoted (e.g., downwardly) to facilitate flush engagement with the curved contours of a patient's skull. Further, it may be preferable for the mounting legs to be frangible upon severe bending for selective removal.

In two exemplary embodiments of the inventive apparatus three or four mounting legs integrally adjoin and extend laterally from a top end of a cylindrical support member. In a top view, the mounting legs and support member each radiate away from the top end of the support member in different directions. Each mounting leg is of a Y-shaped configuration with its base adjoining the support member. Three apertures are disposed at the distal end of each mounting leg so that each of the three apertures are radially offset and one of the apertures is located at a different lateral distance than the other two apertures relative to the top end of the support member. In the three mounting leg embodiment, the support member is disposed at a first acute angle relative to a planar support member/mounting leg adjoinment region, and in the four mounting leg embodiment the support member is disposed at a second acute angle relative to a planar mounting leg/support member adjoinment region, the first acute angle (e.g., 55°) being greater than the second acute angle (e.g., 35°).

In the two noted embodiments, the cylindrical support member may be sized so as to permit passage of at least a portion of an implantable middle ear actuator therethrough, wherein a top end portion of the hearing aid device being may be supportably positioned within the body of the support member. By way example, a bottom end of the support member may be provided with an end plate region to support a top end portion of the actuator thereupon, and an internal portion of the cylindrical support member may be provided to receive a locking member and thereby capture the actuator therewithin.

As noted, an inventive method is also disclosed. The method is directed to the use of a mounting apparatus that includes a support member and a plurality of mounting legs interconnected to and extending laterally from the support member in differing directions. In particular, the inventive method includes the steps of inserting the support member of the mounting apparatus into an opening defined in a patient's skull (e.g., via a mastoidectomy), and selecting at least a first mounting leg from the plurality of mounting legs for attachment to the patient's skull, wherein the selected first mounting leg is located in a first desired attachment location relative to the opening. The method further includes the step of interconnecting a first attachment device to the patient's skull through an aperture provided in the first mounting leg.

Preferably, the inventive method further includes the step of identifying at least a second mounting leg from the plurality of mounting legs for interconnection to the patient's skull and locating the second mounting leg in a second desired attachment location relative to the opening. Then, a second attachment device may be attached to the patient's skull through an aperture provided in the second mounting leg, wherein the first and second attachment devices are radially offset relative to the support member. Optionally the method may further include bending either or both of the first and second mounting legs for conformal skull engagement.

In a further aspect, the inventive method may comprise the additional step of selecting the aperture in the first mounting leg for device attachment from a plurality of apertures provided in the first mounting leg. In this regard, at least two of the plurality of apertures provided in the first mounting leg may be radially offset from each other relative to the support member and/or laterally offset at different distances from the support member.

As may be appreciated, when at least two mounting legs are utilized for attachment, the inventive method may further comprise steps directed to the selection of an aperture in the second mounting leg from a plurality of apertures disposed therethrough. Again, two or more of such apertures in the second mounting leg may be disposed at radially offset locations and/or at different laterally distances from the support member of the second mounting leg. Preferably, at least three radially offset apertures are utilized in two or more mounting legs for stability enhancement.

In an additional aspect, the inventive method may comprise a further step of selecting a mounting apparatus from a plurality of different apparatus each having a support member and a plurality of mounting legs interconnected to and extending laterally from the corresponding support member in differing directions, wherein an angular relationship between the support member and plurality of mounting legs for each of the plurality of mounting apparatus is different.

Numerous additional aspects and advantages of the present invention will become apparent to those skilled in the art upon consideration of further description that follows.

DETAILED DESCRIPTION

Figure 1A:
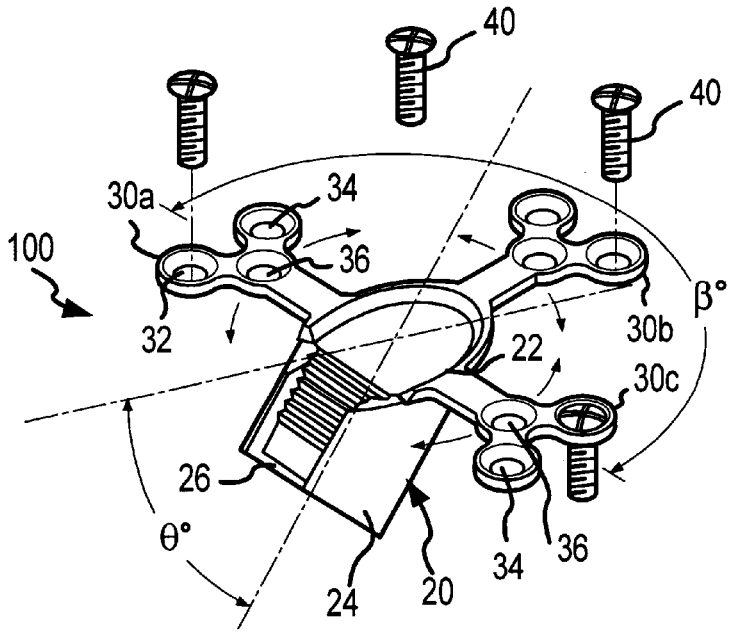
FIG. 1A illustrates one embodiment of a mounting apparatus comprising the present invention.
Figure 1B:
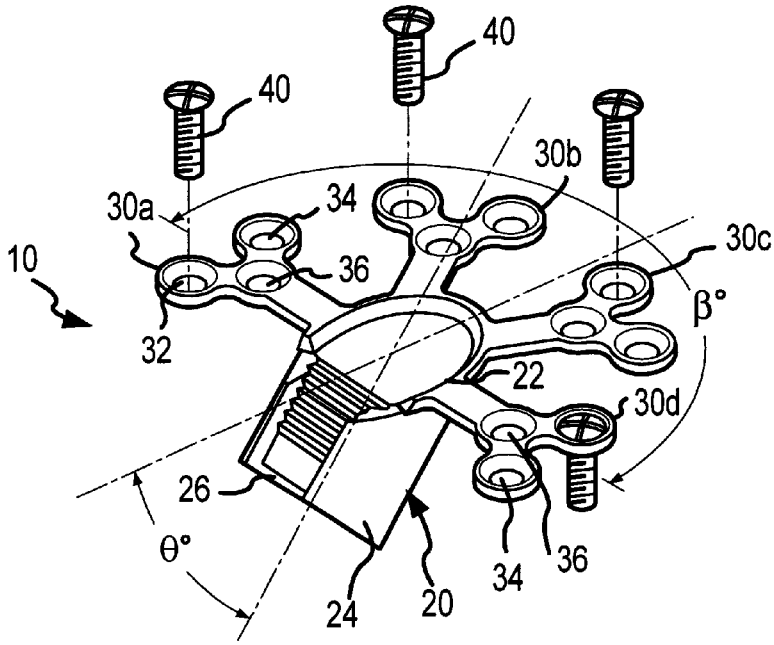
FIG. 1B illustrates another embodiment of a mounting apparatus comprising the present invention.

FIGS. 1A and 1B illustrate two embodiments 10 and 100 of the inventive mounting apparatus. Additional potential embodiments will be apparent to those skilled in the art.

Mounting apparatus 10 includes a support member 20 and four mounting legs 30*a*, 30*b*, 30*c* and 30*d* extending laterally therefrom. The mounting legs 30*a*–30*d* radiate from and are equally spaced within a predetermined arc of β° about one end 22 of the support member 20. In the FIG. 1A embodiment, β° equals 180° so that mounting legs 30*a* and 30*d* are offset 180° to extend in opposite directions, while mounting legs 30*b* and 30*c* form an angle of about 60° relative to mounting legs 30*a* and 30*d*, respectively, and relative to each other.

In order to yield a low profile, the mounting legs 30*a*–30*d* each adjoin the top end 22 of support member 20 in a substantially common plane. Further, the mounting legs 30*a*–30*d* may be provided to be bendable up/down within a predetermined angle range (±30°) relative to the support member 20. Such bendability may be readily provided by fabricating support member 20 and legs 30*a*–30*d* as an integral structure. The bendable mounting legs 30*a*–30*d* facilitate conformal skull interconnection of the mounting apparatus 10, thereby yielding further low-profile and overall stability advantages. Further, legs 30*a*–30*d* may be provided to be selectively frangible by bending (e.g., so as to facilitate conformal fit or avoid undersized obstruction of the opening formed in a patient's skull in conjunction with an implant procedure).

As illustrated, each of the mounting legs 30*a*–30*d* may be of a Y-shaped configuration and include a base member 28 that adjoins support member 20. Such an arrangement facilitates the provision of a plurality of radially and laterally offset mounting apertures 32, 24, and 36 through each mounting leg 30*a*–30*d*. Numerous other mounting leg configurations are also possible (e.g., a simple straight configuration so as to dispose the apertures in a given leg along a line).

In the arrangements of FIGS. 1A and 1B, each of the mounting legs 30*a*–30*d* include three mounting apertures 32, 34 and 36 disposed in a triangular arrangement at a distal, cantilevered end. Apertures 32, 34 and 36 are each provided to selectively receive a skull attachment device 40 (e.g., a screw) therethrough for attachment to a patient's skull. For such purposes, each of the apertures 32, 34 and 36 may be beveled on the top side to facilitate secure skull interconnection with a complimentarily-shaped surface of attachment device(s) 40, while also reducing overall profile upon interconnection.

It should be noted that the apertures 32, 34 and 36 in each of the mounting legs 30*a*–30*d* are radially offset from each other about the support member 20. Further, it should be noted that mounting aperture 32 is located at a different lateral distance from support member 20 than mounting apertures 34 and 36 in each of the mounting legs 30*a*–30*d*. As such, it should be appreciated that the provision of mounting legs 30*a*–30*d* in different corresponding directions, and the provision of a plurality of radially and laterally offset apertures through each mounting leg serve to collectively provide for a number of different mounting location options. In this regard, it is not necessary that attachment devices 40 be utilized in all of the apertures 32, 34, 36 of all of the mounting legs 30*a*–30*d*. It may be preferable, however, to utilize attachment devices 40 in conjunction with at least one of the apertures 32, 34, 36, in at least two and most preferably at least three of the mounting legs 30*a*–30*d*.

As noted above, mounting legs 30*a*–30*d* may adjoin the support member 20 in a substantially common plane. Relatedly, it is preferable for the support member 20 to be disposed at an acute angle of θ° relative to the adjoinment plane. In the embodiment of FIG. 1A, θ is defined to be about 35°. Relatedly, it should also be noted that support member 20 may be disposed so that, in a top view, the body of support member 20 extends from the top end 22 in a non-overlapping orientation relative to the radiating orientations of mounting legs 30*a*–30*d*. Angular orientation of support member 20 relative to the above-noted adjoinment plane, as well as the radiating orientation of support member 20 relative to the adjoinment region with mounting legs 30*a*–30*d*, facilitates supportable positioning of a hearing aid device (e.g., a middle ear actuator) by the mounting apparatus 10 in a desired location within a patient's skull.

In this regard, in the embodiment 10 shown in FIG. 1A support member 20 is defined by a cylindrical barrel 24 through which an implantable hearing aid device may be selectively and supportably positioned. More particularly, and with reference now to FIG. 2, an exemplary hearing aid device 60 (e.g., an electromechanical transducer) is shown for use with the mounting apparatus 10. As illustrated, the barrel 24 of the support member 20 may be provided with an end plate 26 on which at least a portion of the implantable hearing aid device 40 may be supportably received. Further, a portion of an inside surface of the barrel 24 may be threaded to receive a locking ring 50 and thereby supportably capture a portion of the implantable hearing aid device 40 between the locking ring 50 and end plate 26.

Turning now to FIG. 1B, another mounting apparatus embodiment 100 is shown. Mounting apparatus 100 comprises the same basic features, identified with the same reference numerals, as utilized and described above in relation to the embodiment shown in FIG. 1A with two notable differences. First, in the mounting apparatus 100, three mounting legs 30*a*–30*c* are provided at the top end 22 of the support member 20. Mounting legs 30*a*–30*c* radiate within an arc of β° equal to 180°. In particular, mounting leg 30*a* extends in a substantially opposite direction from mounting leg 30*c*, with mounting leg 30*b* radiating therebetween, wherein adjacent legs within the 180° arc define 90° angles therebetween. In addition to these differences, the acute angle of θ° between support member 20 and the adjoinment plane of the mounting legs 30*a*–30*c* and the support member 20 is defined to be about 55°.

Figure 3:
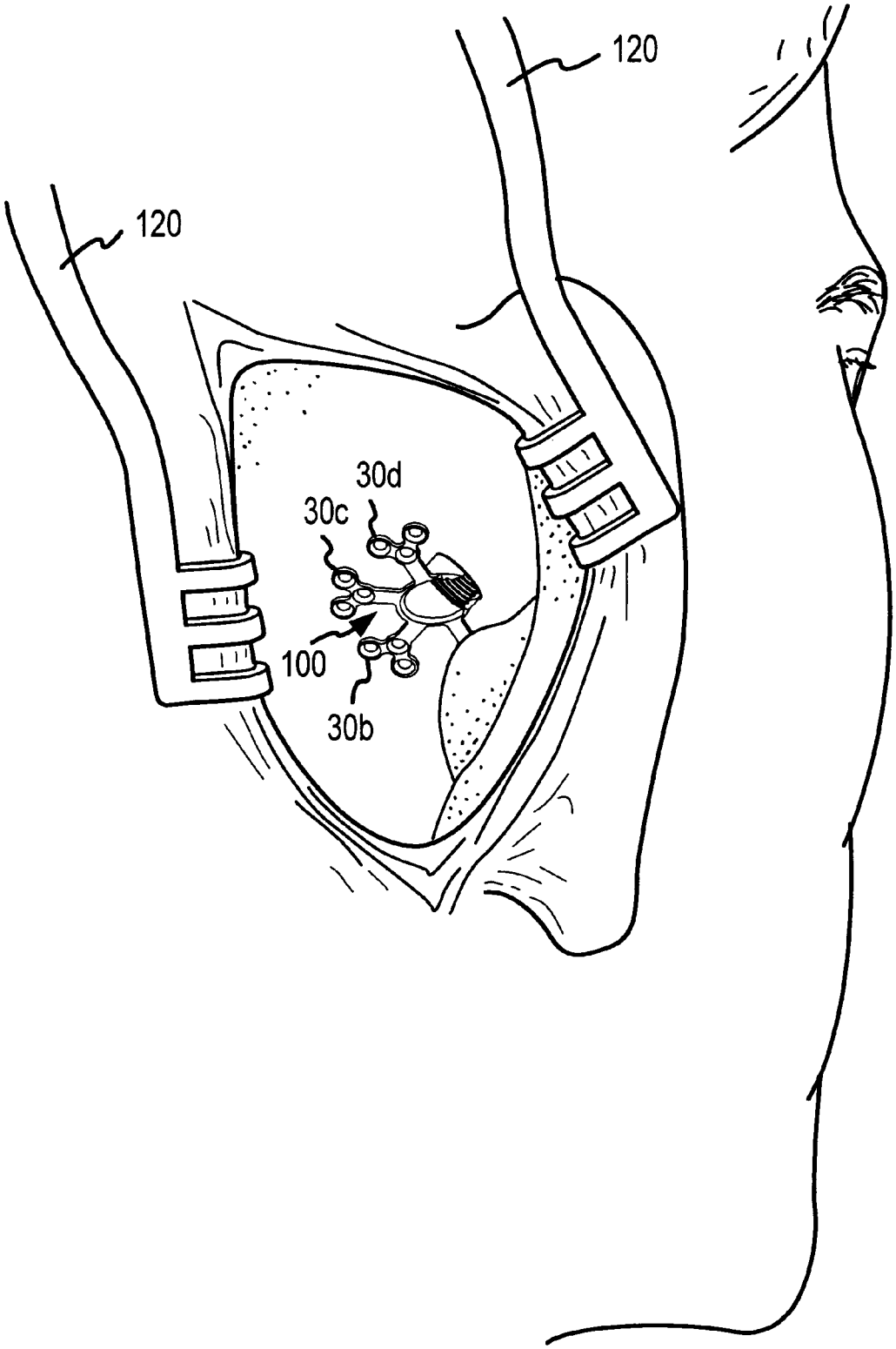
FIG. 3 illustrates the embodiment of FIGS. 1B upon interconnection to a patient's skull.

An exemplary use of the present invention will now be described with reference to FIG. 3. Initially, medical personnel will access the mastoid process of a given patient via an incision made behind the patient's ear. Accessory devices 120 may be utilized for maintaining such access during the implant procedure. Next, an access opening may be formed at a selected location through the mastoid process (e.g., via drilling). Such access opening should be large enough to facilitate placement of a selected mounting apparatus embodiment 100 therethrough. In this regard, the particular mounting apparatus embodiment 100 utilized for a given patient may be selected from a plurality of different arrangements (e.g., the alternative embodiments shown in FIGS. 1A and 1B), as may be appropriate for a given patient.

The selected mounting apparatus embodiment 100 may then be positioned through the defined access opening. As will be appreciated, the above procedures may be completed with the access orientation and mounting apparatus embodiment 100 selected so as to provide a straight line access through the barrel portion 24 of the mounting apparatus 100 to the middle ear of the patient, including for example the ossicular chain and/or oval window.

Following the desired positioning of the mounting apparatus embodiment 100 mounting legs 32*a*–32*d* may be bent into conformal skull engagement as necessary, then the apparatus may be secured to a patient's skull via the insertion and interconnection of one or more attachment devices 40 through one or more selected apertures 32, 34 or 36. Preferably, at least one attachment device 40 will be inserted through an aperture 32, 34 or 36 of each of at least three of the mounting legs 30*a*, 30*b*, 30*c* or 30*d*. In the illustrated embodiment, mounting leg 30*a* (not shown) has been removed to illustrate the benefits of the frangibility feature.

Figure 2:
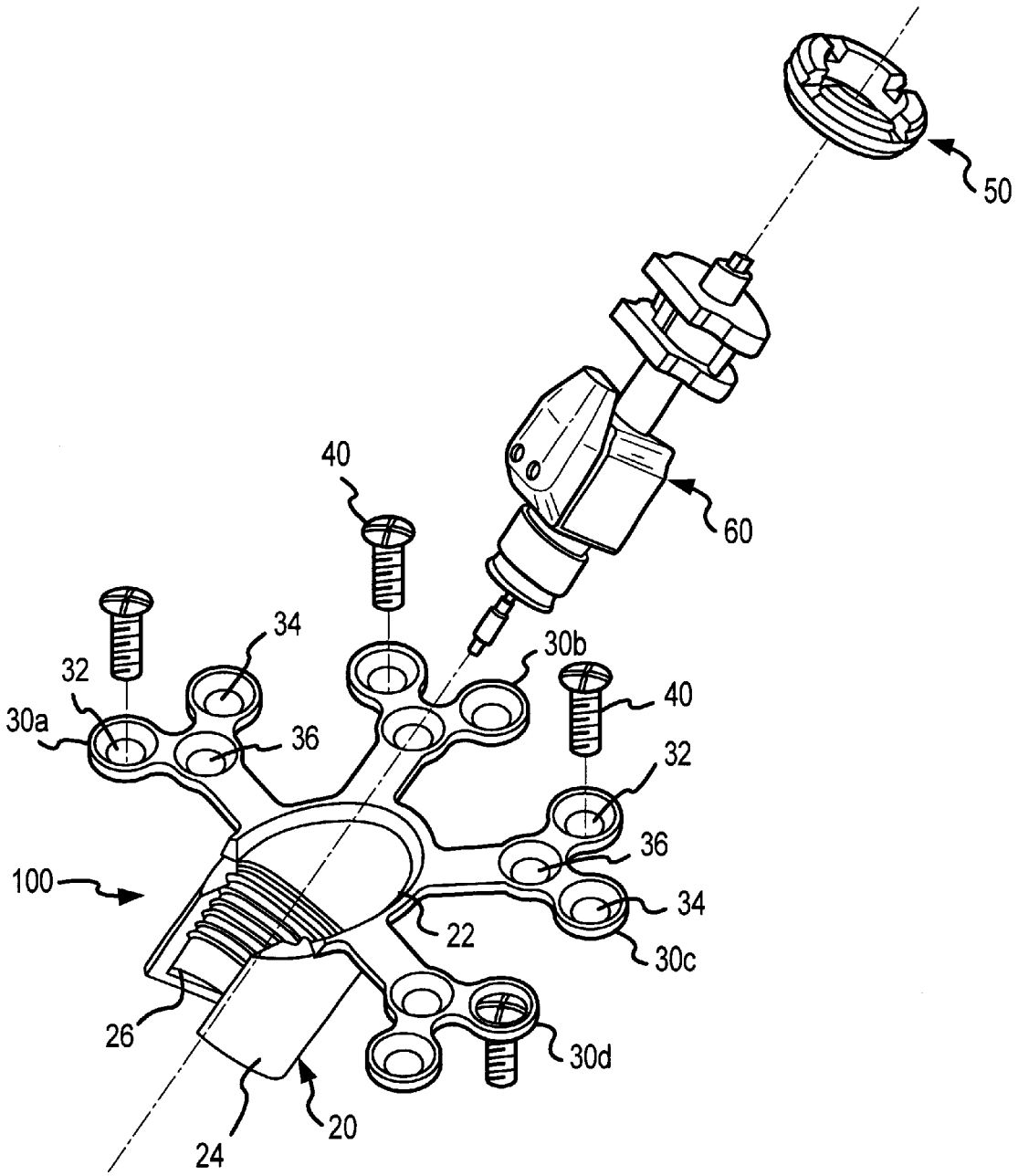
FIG. 2 illustrates the embodiment of FIG. 1B together with an exemplary hearing aid device positioned for supportable mounting in the illustrated embodiment.

After placement of the apparatus 100, an implantable hearing aid device 60 may be supportably positioned into the cylindrical barrel 24 of support member 20. By way of example, the implantable hearing aid device 60 may comprise an electromechanical transducer having a probe tip (e.g., as shown in FIG. 2) adapted for selective contact positioning relative to a middle ear bone or oval window of a patient. Following the desired positioning of the implantable hearing aid device 60, connections to other implanted components of the hearing aid system may be completed. Thereafter, final test procedures, etc. may be completed to ensure that the desired hearing aid implant arrangement has been achieved, after which the incision may be closed to complete the implant procedure.

The description provided above is for purposes of facilitating an understanding of the invention. Other embodiments, applications and modifications will be apparent to those skilled in the art and are intended to be within the scope of the present invention as defined by the claims that follow.

What is claimed is:

1. An apparatus for supportably mounting an implantable hearing aid device to a patient's skull, comprising:

a support member sized for placement through and adapted to support an implantable hearing aid device within a patient's skull; and a plurality of mounting legs interconnected to and extending laterally away from said support member in a corresponding plurality of differing directions, each of said plurality of mounting legs including at least one mounting aperture for selectively receiving a skull attachment device therethrough.

2. An apparatus as recited in claim 1, wherein said plurality of mounting legs radiate from one end of said support member in said corresponding plurality of differing directions.

3. An apparatus as recited in claim 1, wherein said at least one mounting aperture of said plurality of mounting legs are radially offset relative to each other about said support member.

4. An apparatus as recited in claim 1, wherein at least one of said plurality of mounting legs comprises a plurality of mounting apertures.

5. An apparatus as recited in claim 4, wherein said plurality of mounting apertures of said at least one mounting leg include at least two mounting apertures that are located at differing lateral distances from said support member.

6. An apparatus as recited in claim 4, wherein said plurality of mounting apertures of said at least one mounting leg includes at least two mounting apertures which are radially offset from each other relative to said support member.

7. An apparatus as recited in claim 1, wherein each of said plurality of mounting legs comprises at least two apertures that are laterally offset and at least two apertures that are radially offset.

8. An apparatus as recited in claim 1, wherein each of said plurality of mounting legs are integrally formed with said support member.

9. An apparatus as recited in claim 1, wherein said plurality of mounting legs are bendable within an angular range of about ±30° relative to said support member along an adjoinment region therebetween.

10. An apparatus as recited in claim 1, wherein said plurality of mounting legs adjoin a top end of said support member in a substantially planar adjoinment region, and wherein said support member extends from said substantially planar adjoinment region at an acute angle relative thereto.

11. An apparatus as recited in claim 10, wherein said acute angle is between about 20° to 70°.

12. An apparatus as recited in claim 10, wherein each of said plurality of mounting legs radiate from said substantially planar adjoinment region within a predetermined arc, and wherein said support member extends from said substantially planar region in a direction outside of said predetermined arc.

13. An apparatus as recited in claim 1, wherein said support member is of a cylindrical barrel configuration for supportable receipt of an implantable hearing aid device therethrough.

14. A method for use of a mounting apparatus for supportably mounting an implantable hearing aid device to a patient's skull, said mounting apparatus including a support member and a plurality of mounting legs interconnected to and extending laterally from the support member in differing directions, the method comprising:

inserting the support member of the mounting apparatus into an opening in a patient's skull;

selecting at least a first mounting leg from said plurality of mounting legs for attachment to the patient's skull and locating said first mounting leg in a first desired attachment location relative to the opening; and interconnecting a first attachment device to the patient's skull through an aperture provided in said first mounting leg.

15. A method as recited in claim 14, further comprising:

identifying at least a second mounting leg from said plurality of mounting legs for interconnection to the patient's skull and locating the second mounting leg in a second desired attachment location relative to the opening; and attaching a second attachment device to the patient's skull through an aperture provided in said second mounting leg, wherein said first and second attachment devices are radially offset relative to said support member.

16. A method as recited in claim 14, said interconnecting step comprising:

selecting said aperture from a plurality of apertures provided in said first mounting leg.

17. A method as recited in claim 16, wherein at least two of said plurality of apertures are at least one of radially offset from each other relative to said support member and laterally offset at different distances from said support member.

18. A method as recited in claim 16, said attaching step comprising:

selecting said aperture in said second mounting leg from a plurality of apertures provided in the second mounting leg.

19. A method as recited in claim 14, further comprising:

selecting said mounting apparatus from a plurality of mounting apparatus each having a support member and a plurality of mounting legs interconnected to and extending laterally from a substantially planar adjoinment region with the support member in differing directions, wherein an angular relationship between the support member and said substantially planar adjoinment region for each of said plurality of mounting apparatus is different.

20. A method as recited in claim 19, wherein each of said plurality of mounting apparatus comprise a different corresponding number of mounting legs.

* * * * *